US010533557B2

(12) United States Patent
Bevington

(10) Patent No.: US 10,533,557 B2
(45) Date of Patent: Jan. 14, 2020

(54) CUTTING ASSEMBLY FOR A CHOPPER PUMP

(71) Applicant: Pentair Flow Technologies, LLC, Delavan, WI (US)

(72) Inventor: Jack Bevington, Ashland, OH (US)

(73) Assignee: Pentair Flow Technologies, LLC, Delavan, WI (US)

( * ) Notice: Subject to any disclaimer, the term of this patent is extended or adjusted under 35 U.S.C. 154(b) by 302 days.

(21) Appl. No.: 15/498,085

(22) Filed: Apr. 26, 2017

(65) Prior Publication Data

US 2017/0306965 A1 Oct. 26, 2017

Related U.S. Application Data

(60) Provisional application No. 62/327,810, filed on Apr. 26, 2016.

(51) Int. Cl.

| | |
|---|---|
| ***F04D 7/04*** | (2006.01) |
| ***F04D 29/22*** | (2006.01) |
| ***F04D 29/28*** | (2006.01) |

(52) U.S. Cl.

CPC ..... *F04D 7/045* (2013.01); *F04D 29/2288* (2013.01); *F04D 29/28* (2013.01)

(58) Field of Classification Search

CPC ..... F04D 7/045; F04D 29/622; F04D 29/28; F04D 29/2288; F04D 29/106; F04D 29/225; F04D 29/126; F04D 29/165; B02C 18/362

See application file for complete search history.

(56) References Cited

U.S. PATENT DOCUMENTS

| | | | |
|---|---|---|---|
| 1,148,547 | A | 8/1915 | Smith |
| 2,262,039 | A | 11/1941 | Pekor |
| 2,265,758 | A | 12/1941 | Klosson |
| 2,420,420 | A | 5/1947 | Durdin, Jr. |
| 2,496,359 | A | 2/1950 | Rymann |
| 3,073,535 | A | 1/1963 | Vokes |
| 3,096,718 | A | 7/1963 | Anderson |
| 3,128,051 | A | 4/1964 | Smith |
| 3,155,330 | A | 11/1964 | Holz et al. |
| 3,444,818 | A | 5/1969 | Sutton |
| 3,447,475 | A | 6/1969 | Blum |
| 3,692,422 | A | 9/1972 | Girardier |
| 3,915,394 | A | 10/1975 | Ferguson, Jr. |

(Continued)

FOREIGN PATENT DOCUMENTS

| | | |
|---|---|---|
| CN | 202789688 U | 3/2013 |
| DE | 1528694 A1 | 5/1969 |

(Continued)

*Primary Examiner* — George C Jin

(74) *Attorney, Agent, or Firm* — Husch Blackwell LLP

(57) ABSTRACT

Embodiments of the invention provide a cutting assembly for a chopper pump. The cutting assembly includes a cutting insert having a cutting blade extending radially therefrom, and an impeller having a central hub, a plurality of vanes, and an insert surface. The insert surface defines an axial recess that is dimensioned to receive the cutting insert therein. The cutting assembly further includes a cutting plate having a plate hub with a cutting extension protruding radially inward therefrom. Rotation of the impeller rotates the cutting blade past the cutting extension.

21 Claims, 14 Drawing Sheets

(56) References Cited

U.S. PATENT DOCUMENTS

| | | | | |
|---|---|---|---|---|
| 3,973,866 | A | 8/1976 | Vaughan | |
| 4,842,479 | A | 6/1989 | Dorsch | |
| 4,904,159 | A | 2/1990 | Wickoren | |
| 5,011,370 | A | 4/1991 | Sodergard | |
| 5,076,757 | A | 12/1991 | Dorsch | |
| 5,256,032 | A | 10/1993 | Dorsch | |
| 5,456,580 | A | 10/1995 | Dorsch | |
| 5,460,482 | A | 10/1995 | Dorsch | |
| 5,460,483 | A | 10/1995 | Dorsch | |
| 6,029,917 | A | 2/2000 | Jensen | |
| 6,190,121 | B1 | 2/2001 | Hayward et al. | |
| 6,224,331 | B1 * | 5/2001 | Hayward | F04D 7/045 415/121.1 |
| D524,827 | S | 7/2006 | Byrne | |
| 7,080,797 | B2 | 7/2006 | Doering et al. | |
| 7,118,327 | B2 | 10/2006 | Doering et al. | |
| 7,125,221 | B2 * | 10/2006 | Dorsch | F04D 7/045 415/121.1 |
| 7,159,806 | B1 | 1/2007 | Ritsema | |
| 7,168,915 | B2 | 1/2007 | Doering et al. | |
| 7,234,657 | B2 | 6/2007 | Doering et al. | |
| 7,455,251 | B2 | 11/2008 | Doering et al. | |
| 7,461,804 | B2 * | 12/2008 | Walters | B02C 18/362 241/292.1 |
| 7,607,884 | B2 | 10/2009 | Cohen | |
| D607,023 | S | 12/2009 | Perkovich et al. | |
| 7,811,051 | B2 | 10/2010 | Wagner | |
| 7,841,550 | B1 | 11/2010 | Dorsch et al. | |
| 7,967,553 | B2 | 6/2011 | Wagner | |
| 8,105,017 | B2 | 1/2012 | Dorsch et al. | |
| 8,197,192 | B2 | 6/2012 | Andersson | |
| 8,231,337 | B2 | 7/2012 | Andersson | |
| 8,267,643 | B2 | 9/2012 | Wagner et al. | |
| 8,366,384 | B2 | 2/2013 | Södergård | |
| 8,485,530 | B2 | 7/2013 | Johansson et al. | |
| 8,500,393 | B2 | 8/2013 | Cartwright et al. | |
| 8,523,187 | B2 | 9/2013 | Eriksson | |
| 8,562,287 | B2 | 10/2013 | Schmidt et al. | |
| 8,608,428 | B2 | 12/2013 | Andersson | |
| 8,633,623 | B2 | 1/2014 | Bingler | |
| 8,657,564 | B2 | 2/2014 | Cuppetelli | |
| 8,764,278 | B2 | 7/2014 | Fondelius | |
| 8,905,341 | B2 | 12/2014 | Dorsch et al. | |
| 8,985,490 | B2 | 3/2015 | Dorsch et al. | |
| 2004/0234370 | A1 | 11/2004 | Simakaski et al. | |
| 2010/0092276 | A1 * | 4/2010 | Cartwright | F04D 7/045 415/121.1 |
| 2013/0108411 | A1 * | 5/2013 | Ciotola | B02C 18/0092 415/1 |
| 2013/0121811 | A1 * | 5/2013 | Cuppetelli | F04D 29/2288 415/121.1 |
| 2014/0064929 | A1 | 3/2014 | Adams et al. | |
| 2014/0308142 | A1 | 10/2014 | Andersson | |
| 2014/0363273 | A1 | 12/2014 | Burman | |
| 2014/0377055 | A1 * | 12/2014 | Garvin | F04D 29/2288 415/121.1 |

FOREIGN PATENT DOCUMENTS

| | | | |
|---|---|---|---|
| DE | 3015755 | A1 | 11/1981 |
| DE | 4319616 | A1 | 12/1994 |
| DE | 19834815 | A1 | 2/2000 |
| DE | 102004058458 | B3 | 5/2006 |
| EP | 0406788 | A2 | 1/1991 |
| EP | 1344944 | A1 | 9/2003 |
| GB | 584395 | A | 1/1947 |
| GB | 1486237 | A | 9/1977 |
| GB | 2391266 | A | 2/2004 |
| WO | 2007143853 | A1 | 12/2007 |

* cited by examiner

CUTTING ASSEMBLY FOR A CHOPPER PUMP

RELATED APPLICATIONS

This application claims priority under 35 U.S.C. § 119 to U.S. Provisional Patent Application No. 62/327,810 filed on Apr. 26, 2016, the entire contents of which is incorporated herein by reference.

BACKGROUND

The present invention relates generally to a chopper pump for pumping fluids containing solid matter and, more specifically, to a cutting assembly for breaking up solid matter in the fluid being supplied to the chopper pump into smaller pieces.

Chopper pumps are implemented when a fluid supply contains solid matter that needs to be pumped, or displaced. The fluid supply is provided to an inlet of the chopper pump where an impeller rotates adjacent to a cutting, plate that may be hardened. Rotation of the impeller adjacent to the cutting plate engages the solid matter and displaces the fluid supply from the inlet to an outlet. Typically, chopper pumps include a hardened impeller to aid in cutting the solid matter and increase the durability of the impeller. However, hardening an impeller inhibits the ability of a user to trim (i.e., remove material from) the impeller to customize pump performance and/or contour the ultimate form factor of the impeller. Additionally, solid matter can become stuck or lodged between the impeller and the cutting plate during operation of the chopper pump, which leads to clogging and/or reduced pump efficiency.

In light of at least the above shortcomings, a need exits for an improved cutting assembly for a chopper pump that aids in removing solid matter that can inhibit performance and enables the form factor of the chopper pump impeller to be contoured or modified, if desired, while maintaining, or improving, cutting performance.

SUMMARY

The aforementioned shortcomings can be overcome by providing a cutting assembly for a chopper pump having a cutting insert removably received within a recess in an impeller and arranged adjacent to a cutting plate. The cutting insert is a separate component from the impeller, which negates the desire for the entire impeller to be fabricated from a hardened material. The cutting assembly disclosed allows the discrete cutting insert to be fabricated from a hardened material enabling the impeller, which may not be hardened in certain situations, to be trimmed or modified, if desired. Additionally, the cutting plate includes one or more cutting plate grooves to aid in removing solid matter that could get stuck between the cutting blade insert and the cutting plate.

Some embodiments of the invention provide a cutting assembly for a chopper pump. The cutting assembly includes a cutting insert having a cutting blade extending radially therefrom, and an impeller having a central hub, a plurality of vanes, and an insert surface. The insert surface defines an axial recess that is dimensioned to receive the cutting insert therein. The cutting assembly further includes a cutting plate having a plate hub with a cutting extension protruding radially inward therefrom. Rotation of the impeller rotates the cutting blade past the cutting extension.

Some embodiments of the invention provide a chopper pump including a drive section having a drive shaft, and a housing coupled to the drive section and having an inlet, an outlet, and an internal cavity arranged between the inlet and the outlet. The chopper pump further includes an impeller received within the internal cavity and coupled to, the drive shaft for rotation therewith. The impeller includes a recess formed therein. The chopper pump further includes a cutting insert received within the recess of the impeller and having a cutting blade, and a cutting plate coupled to the housing within the internal cavity. The cutting plate includes a cutting extension that extends radially inward. Rotation of the impeller rotates the cutting blade past the cutting extension.

DETAILED DESCRIPTION

Figure 1:
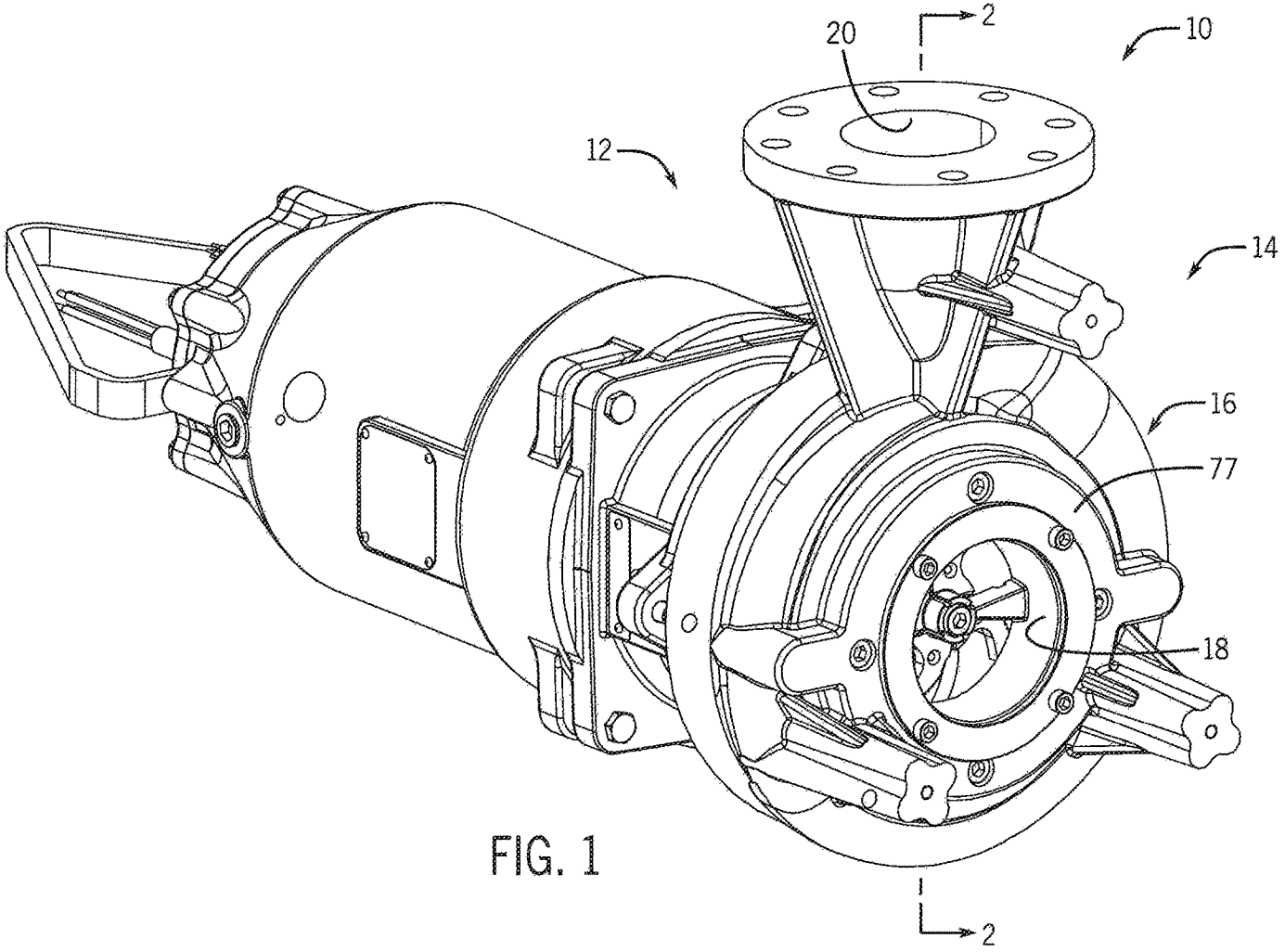
FIG. 1 is a perspective view of a chopper pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a chopper pump 10 according to one embodiment of the invention. The chopper pump 10 includes a drive section 12 coupled to an inlet section 14. The inlet section 14 includes a housing 16 having an inlet 18 and an outlet 20. In operation, the chopper pump 10 furnishes a process fluid from the inlet 18 of the housing 16 to the outlet 20 of the housing 16, as will be described in detail below.

Figure 2:
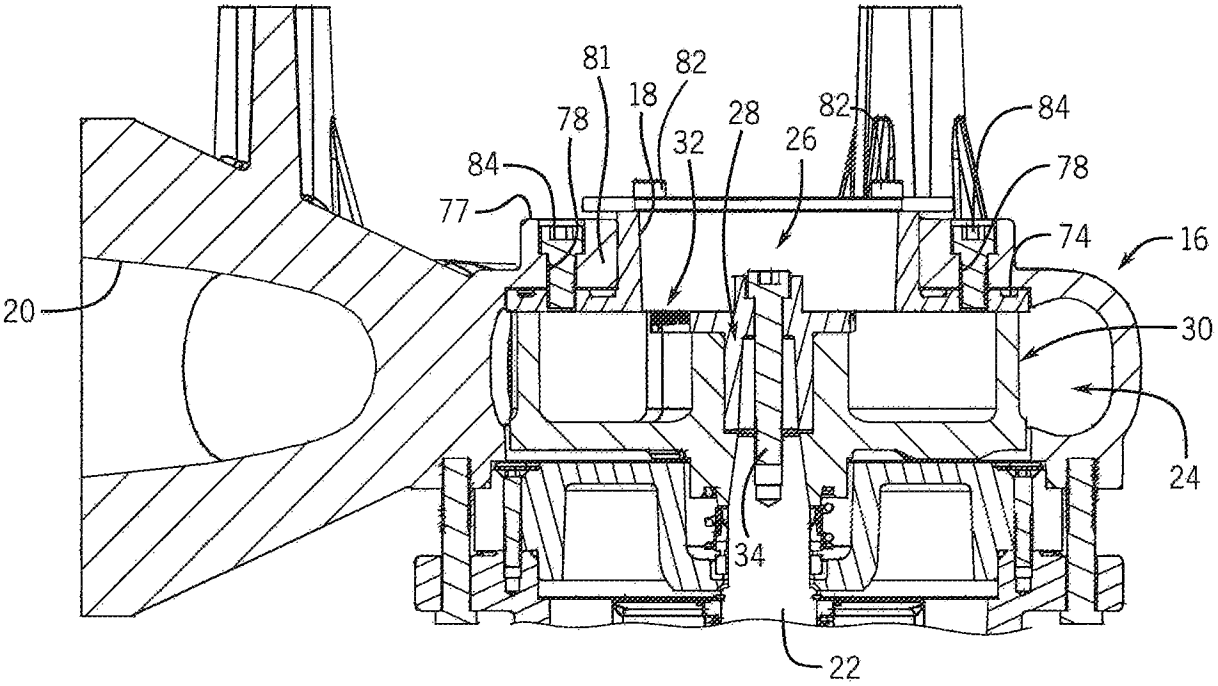
FIG. 2 is a partial cross-sectional view of the chopper pump of FIG. 1 taken along line 2-2.

As shown in FIG. 2, the drive section 12 includes a drive shaft 22 extending through the drive section 12. The drive shaft 22 may extend through one or more bearings (not shown) and may be coupled to a driving mechanism (e.g., an electric motor or an internal combustion engine) that rotates the drive shaft 22 in a desired direction for pumping of the supply fluid from the inlet 18 to the outlet 20.

The housing 16 defines an internal cavity 24 in fluid communication with the inlet 18 and the outlet 20. A cutting assembly 26 is configured to be arranged within the internal cavity 24 of the housing 16. The cutting assembly 26 includes a cutting insert 28, an impeller 30, and a cutting plate 32. The cutting insert 28 is releasably coupled to the impeller 30 and is arranged adjacent to the cutting plate 32. The cutting insert 28 and the impeller 30 are fastened to the drive shaft 22 via an impeller fastening element 34 in the form of a threaded bolt. This enables the impeller 30 and the cutting insert 28 to rotate with the drive shaft 22 in a desired direction.

Figure 3:
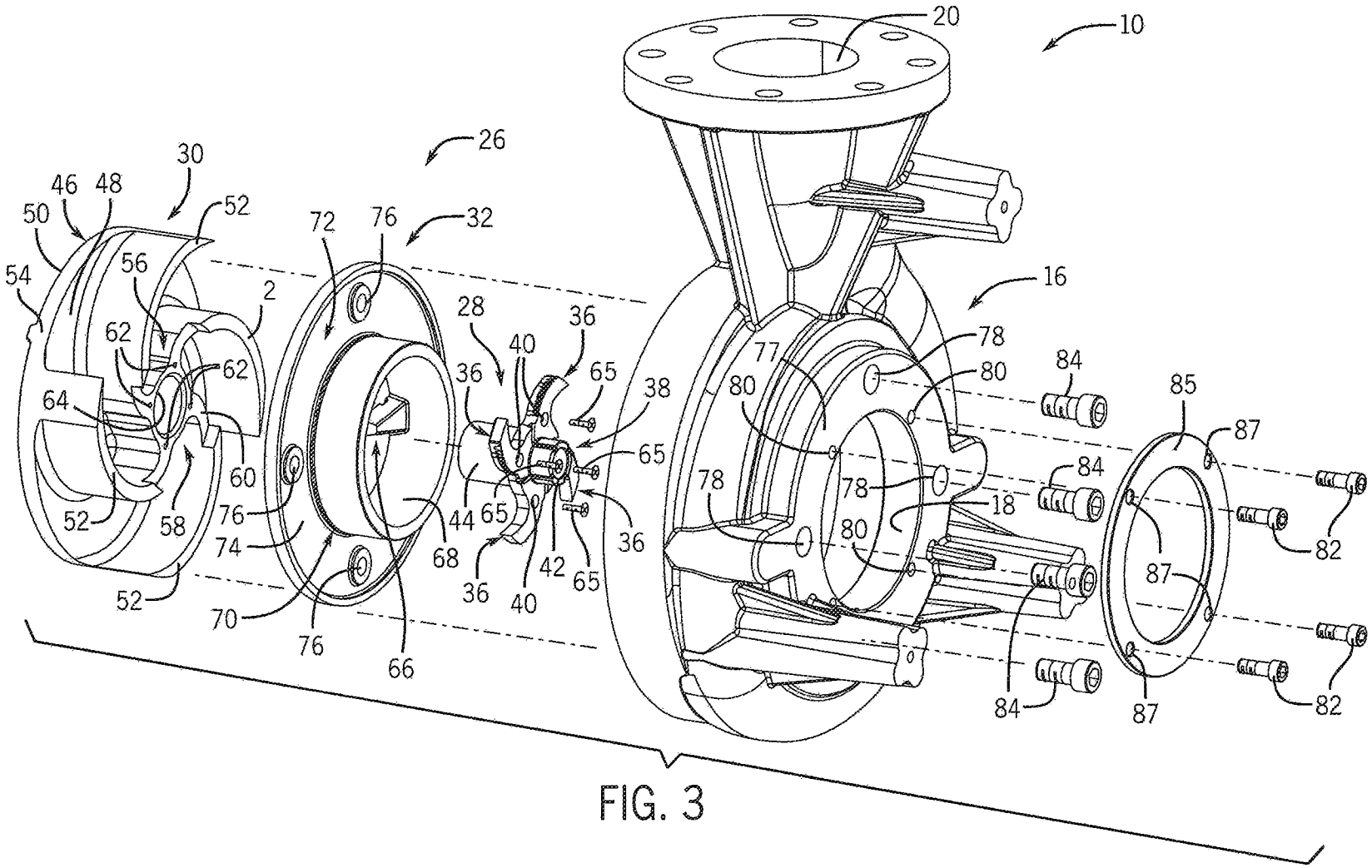
FIG. 3 is an exploded view of a cutting assembly and a housing of the chopper pump of FIG. 1.

As shown in FIG. 3, the cutting insert 28 includes a plurality of cutting blades 36 extending generally radially from and arranged circumferentially around an insert central hub 38. The plurality of cutting blades 36 define a substantially curved shape and include a mounting aperture 40 extending therethrough. The mounting apertures 40 are arranged adjacent to the insert central hub 38. The cutting insert 28 is preferably fabricated from a hardened metal material 440SST, PH grades of stainless, such as, 17-7PH, 17-5PH, and 15-5PH, as well as other hardenable steels). A hardness of the cutting plate 28 can be greater (i.e., harder) than a hardness of the impeller 30. The insert central hub 38 includes a first protrusion 42 extending substantially perpendicularly from a proximal end of the plurality of cutting blades 36 in a first direction, and a second protrusion 44 extending substantially perpendicularly from the proximal end of the plurality of cutting blades 36 in a second direction opposite the first direction.

Figure 10:
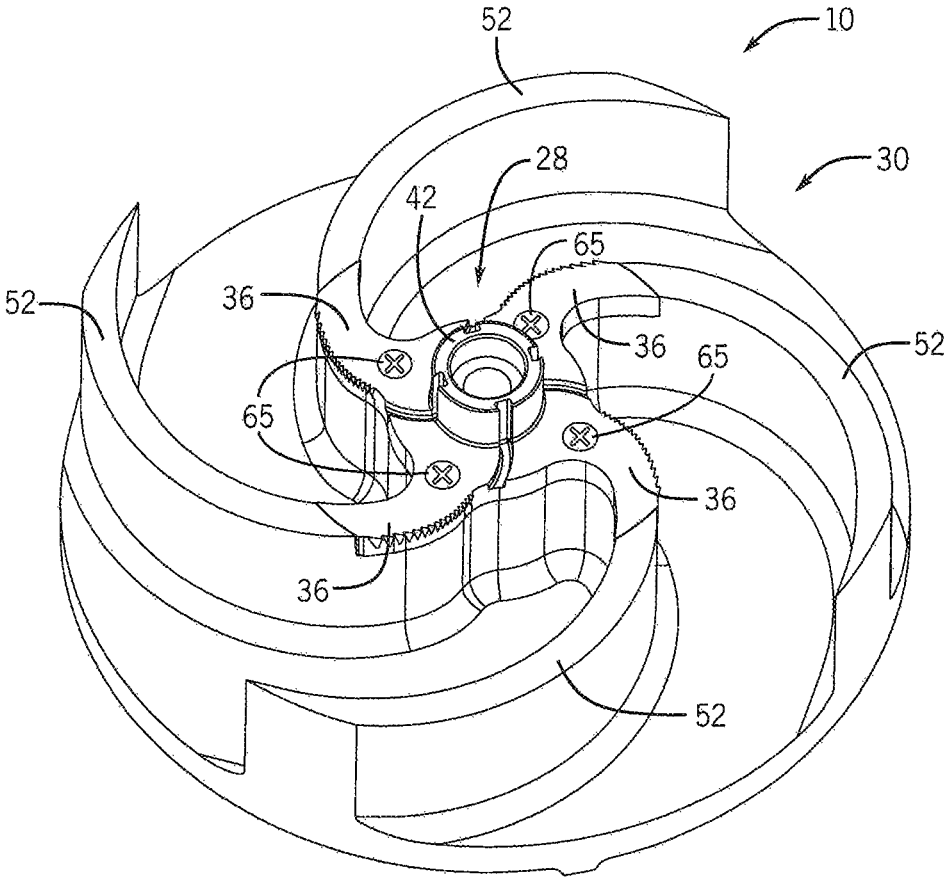
FIG. 10 is a perspective view of the cutting plate and the impeller of the chopper pump of FIG. 1.

The illustrated impeller 30 is in the form of a semi-open impeller. In other embodiments, the impeller 30 may be in the form of an open impeller or any other form capable of receiving a cutting insert. The impeller 30 includes a shroud 46 having a first shroud surface 48 and an opposing second shroud surface 50. A plurality of vanes 52 extend from and are arranged circumferentially around the first shroud surface 48 of the impeller 30. The plurality of vanes 52 define a substantially curved shape that curves from a shroud outer surface 54 of the shroud 46 toward a central hub 56 of the impeller 30. The curvature defined by the plurality of vanes 52 is similar to the curvature defined by the plurality of cutting blades 36 (as shown in FIG. 10). In other embodiments, the plurality of vanes 52 may define an alternative shape, for example a substantially straight, or linear, shape between the shroud outer surface 54 and the central hub 56. The illustrated impeller 30 includes four vanes 52. In other embodiments, the impeller 30 may include more or less than four vanes 52.

The central hub 56 of the impeller 30 includes a recess 58 defined by an insert surface 60 that is axially recessed and dimensioned to receive the cutting insert 28. The recess 58 is dimensioned to accommodate the cutting insert 28 therein. The insert surface 60 extends from the central hub 56 partially along each of the plurality of vanes 52. That is, each of the plurality of vanes 52 defines a step change in an axial dimension at a location between the shroud outer surface 54 and the central hub 56. The location at which the step change in axial dimension occurs in each of the plurality of vanes 52 is congruent with a distance that the plurality of cutting blades 36 radially extend from the insert central hub 38 of the cutting insert 28. Additionally, an axial depth of the recess 58 (i.e., the magnitude of the step change in axial dimension of the plurality of vanes 52) is congruent with a thickness of the plurality of cutting blades 36. In this way, when the cutting insert 28 is inserted into the recess 58 of the impeller 30 (as shown in FIG. 10), the plurality of cutting blades 36 are arranged flush with the plurality of vanes 52.

With continued reference to FIG. 3, the insert surface 60 includes a plurality of insert apertures 62 recessed into the insert surface 60 and arranged circumferentially around a central hub aperture 64 of the central hub 56. The plurality of insert apertures 62 are each dimensioned to threadably received a fastening element 65, which may be in the form of an flathead cap screw or bolt. The plurality of insert apertures 62 are arranged to align with the mounting apertures 40 of the cutting insert 28. During assembly and operation, the insert apertures 62 are configured to align with the mounting apertures 40 to enable the fastening elements 65 to extend through the mounting apertures 40 and thread into the insert apertures 62. This properly locates the cutting insert 28 within the recess 58 and rotationally secures the cutting insert 28 and the impeller 30 (i.e., prevent the cutting insert 28 from slipping, or becoming rotationally offset, with respect to the impeller 30). The central hub aperture 64 is dimensioned to receive the backward second protrusion 44 of the insert central hub 38.

The cutting plate 32 includes a cutting extension 66 protruding radially inward from an inner surface 68 of a plate hub 70. The illustrated cutting plate 32 includes one cutting extension 66 arranged on the inner surface 68 of the plate hub 70. In other embodiments, the cutting plate 32 may include more than one cutting extensions 66 arranged circumferentially around the inner surface 68. For example, in one embodiment, the cutting plate 32 may include two cutting extensions 66 arranged circumferentially in approximately 180 degree increments on the inner surface 68. In another embodiment, the cutting plate 32 may include three cutting extensions 66 arranged circumferentially in approximately 120 degree increments on the inner surface 68.

The inner surface 68 of the plate hub 70 defines an opening with a diameter that is substantially equal to a diameter of the inlet 18 of the housing 16. The plate hub 70 extends substantially perpendicularly from a base 72 of the cutting plate 32. The base 72 of the cutting plate 32 includes a mounting surface 74 having a plurality of threaded mounting apertures 76 arranged circumferentially around and extending through the mounting surface 74.

The housing 16 includes an inlet face 77 having a plurality of plate apertures 78 and a plurality of threaded ring apertures 80 arranged thereon. The plurality of plate apertures 78 and the plurality of threaded ring apertures 80 are alternatingly arranged circumferentially around the inlet face 77 of the housing 16. The plurality of plate apertures 78 extend axially through an inlet wall 81 of the housing 16, which circumscribes the inlet 18. The plurality of plate apertures 78 are dimensioned to receive a fastening element 84 in the form of a threaded bolt. The plurality of ring apertures 80 extend partially through the inlet wall 81 and are arranged radially inward compared to the plurality of plate apertures 78. The plurality of ring apertures 80 are dimensioned to receive a fastening element 82 in the form of a threaded bolt.

When assembled (as shown in FIGS. 1 and 2), each of the fastening elements 84 is inserted into and through a corresponding one of the plurality of plate apertures 78 and threaded into a corresponding one of the plurality of threaded mounting apertures 76 on the mounting surface 74 of the cutting plate 32. This fastens the cutting plate 32 within the internal cavity 24 of the housing 16 adjacent to the inlet 18. Each of the plurality of fastening elements 82 is threaded into a corresponding one of the plurality of threaded ring apertures 80 to secure a retainer ring 85 in engagement with a distal end of the plate hub 70, which may extend partially out of the inlet 18. The retainer ring 85 defines a generally annular shape and includes a plurality of retainer apertures 87 arranged circumferentially thereon. The retainer apertures 87 are arranged to align with the ring apertures 80, when assembled.

The relative threaded interaction between the fastening elements 84 secured to the cutting plate 32 and the fastening elements 82 securing the retainer ring 85 enables the axial relation between the cutting plate 32 and the cutting insert 28 to be selectively controlled. That is, the cutting plate 32 is axially adjustable by adjusting, an axial depth that the fastening elements 84 are threaded into the plurality of threaded mounting apertures 76 and/or by adjusting an axial distance between the inlet face 77 and the retainer ring 85, which is set by the fastening elements 82. In one implementation, the axial relation between the cutting plate 32 and the cutting insert 28 may be set by the axial depth the fastening elements 84 are threaded into the threaded mounting apertures 76, and the retainer ring 85 may be utilized to secure the cutting plate 32 in place via the fastening elements 82. In another implementation, the axial relation between the cutting plate and the cutting insert 28 may be set by the axial distance between the retainer ring 85 and the inlet face 77, which is controlled via the fastening elements 82, and the fastening elements 84 may be utilized to secure the cutting plate 32 in place.

Figure 5:
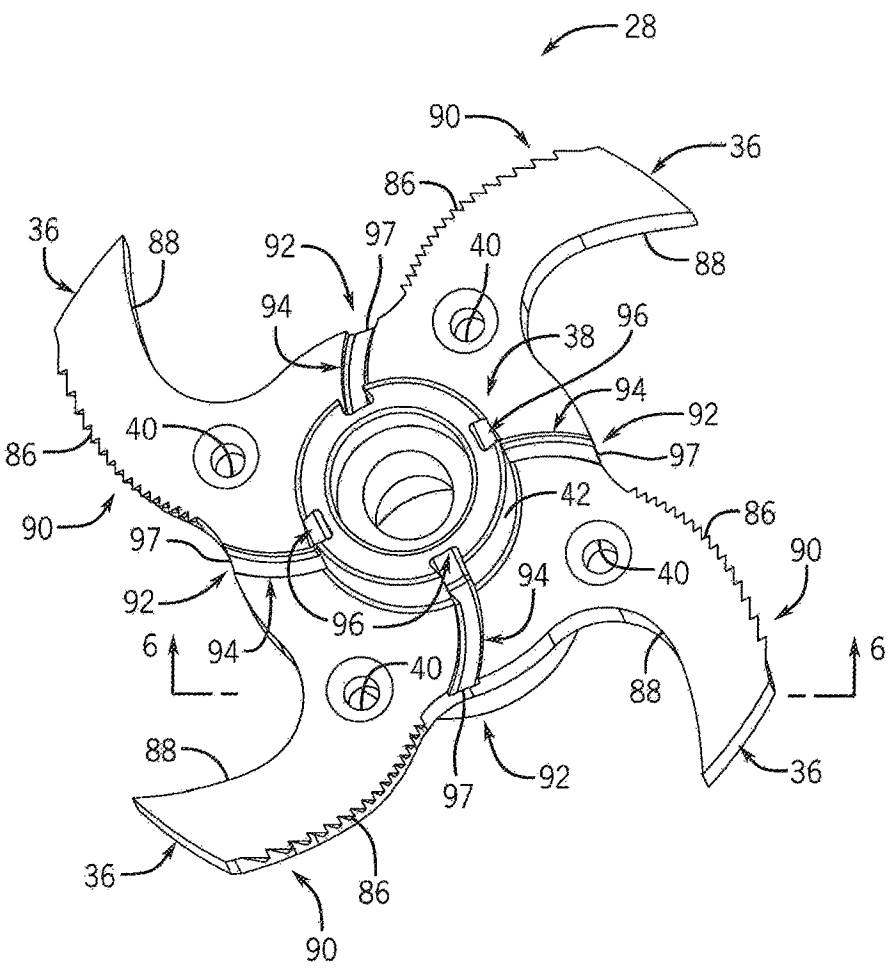
FIG. 5 is a front perspective view of the cutting insert of the chopper pump of FIG. 1.
Figure 4:
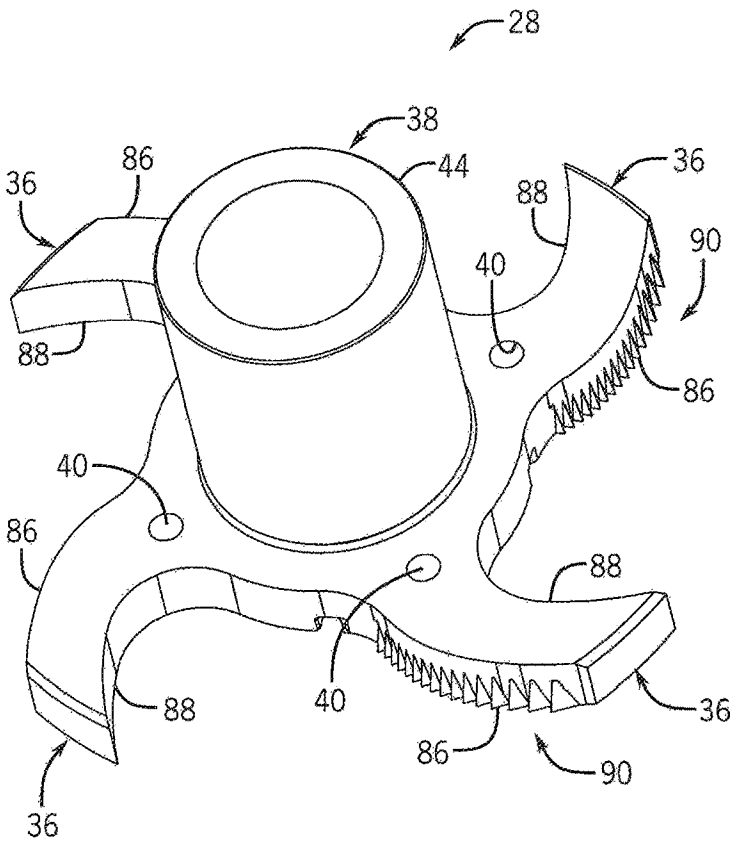
FIG. 4 is a back perspective view of a cutting insert of the chopper pump of FIG. 1.
Figure 6:
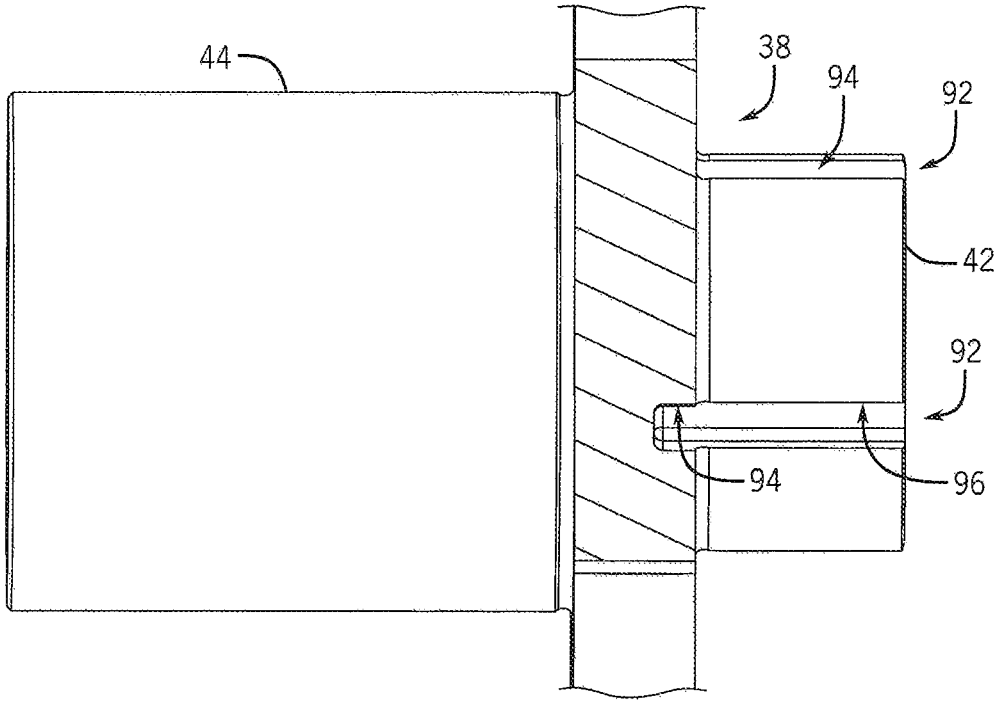
FIG. 6 is a cross-section view of the cutting insert of FIG. 5 taken along line 6-6.

As shown in FIGS. 4 and 5, the plurality of cutting blades 36 include a leading edge 86 and a trailing edge 88. The leading edges 86 include a plurality of serrated teeth 90 arranged therealong to aid in cutting or engaging solid matter, as will be described below. The cutting insert 28 includes a plurality of cutting grooves 92 arranged circumferentially thereon. The plurality of cutting grooves 92 include a radial section 94 and an axial section 96 arranged substantially perpendicularly to the radial section 94. The radial sections 94 are axially recessed into the cutting insert 28 and each extend radially along a substantially curved profile from a proximal end 97 of a corresponding one of the leading edges 86 to the forward first protrusion 42. The axial sections 96 are radially recessed into the forward first protrusion 42 and extend axially along the length of the forward first protrusion 42 in a substantially linear profile. The plurality of cutting grooves 92 each define a substantially rectangular recess formed in the cutting insert 28, as shown in FIG. 6. In other embodiments, the plurality of cutting grooves 92 may define another shape (e.g., arcuate, round, curved, triangular, etc.), as desired.

Figure 7:
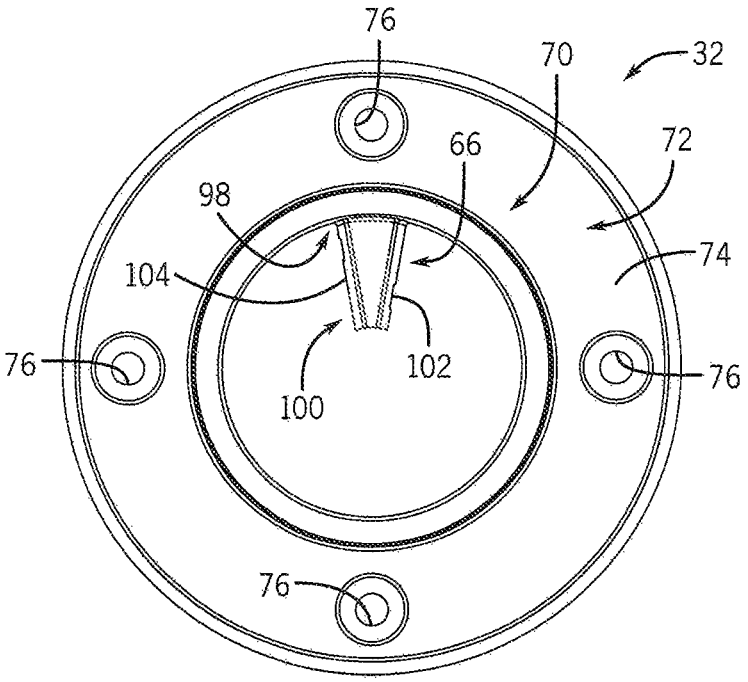
FIG. 7 is a front view of a cutting plate of the chopper pump of FIG. 1.
Figure 8:
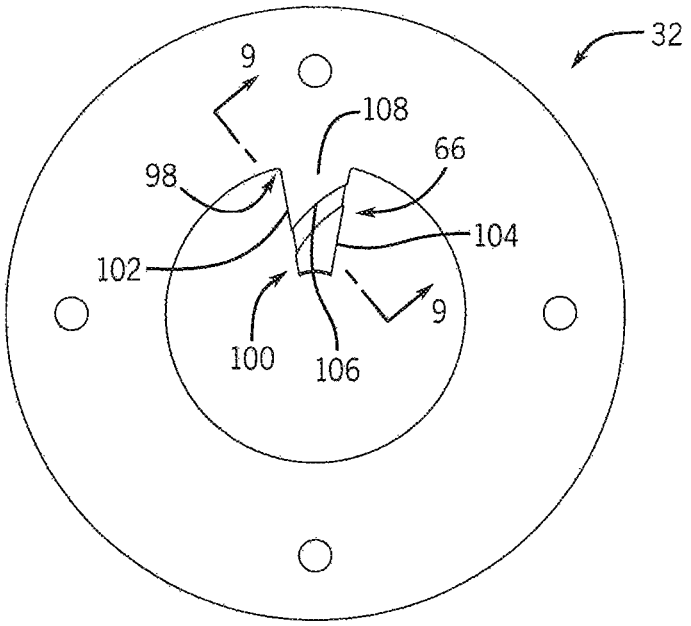
FIG. 8 is a back view of the cutting plate of the chopper pump of FIG. 1.
Figure 9:
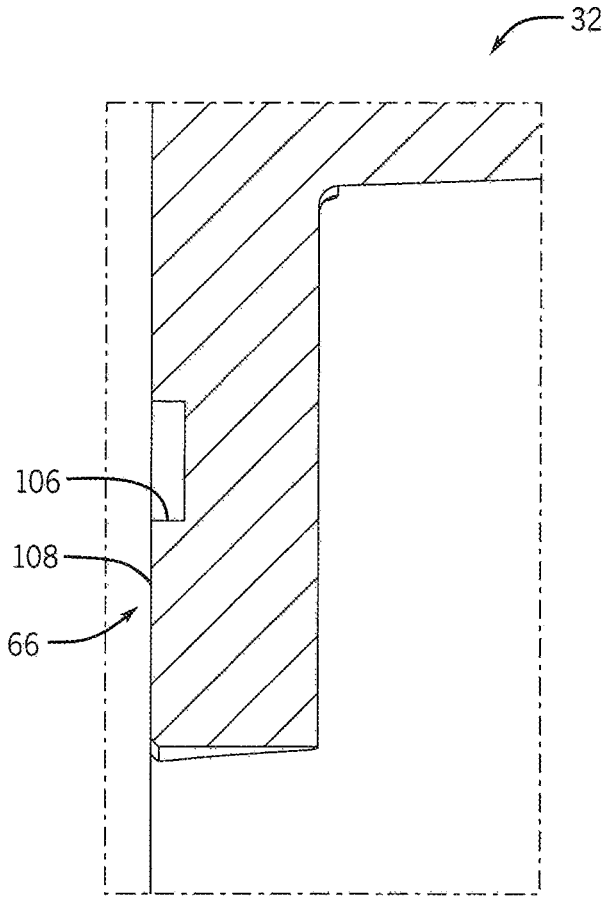
FIG. 9 is a cross-sectional view of the cutting plate of FIG. 8 taken along line 9-9.

As shown in FIGS. 7 and 8, the cutting extension 66 of the cutting plate 32 defines a substantially frustoconical shape that tapers from a proximal end 98 to a distal end 100. The distal end 100 of the cutting extensions 66 defines a generally concave shape. The cutting extension 66 includes a first cutting edge 102, a second cutting edge 104, and an extension groove 106. The first cutting edge 102 and the second cutting edge 104 are sharpened (e.g., tapered down to a point) to aid in cutting or engaging solid matter. The extension groove 106 is arranged on a back surface 108 of the cutting extensions 66 and defines an axial recess therein. The extension groove 106 extends radially along a substantially curved profile from a location on the first cutting edge 102 adjacent to the distal end 100 to a location on the second cutting edge 104 adjacent to the proximal end 98. The extension groove 106 defines an axial recess with a substantially rectangular shape formed in the back surface 108 of the cutting extensions 66, as shown in FIG. 9. In other embodiments, the extension groove 106 may define another shape (e.g., arcuate, round, curved, triangular, etc.), as desired.

Figure 11:
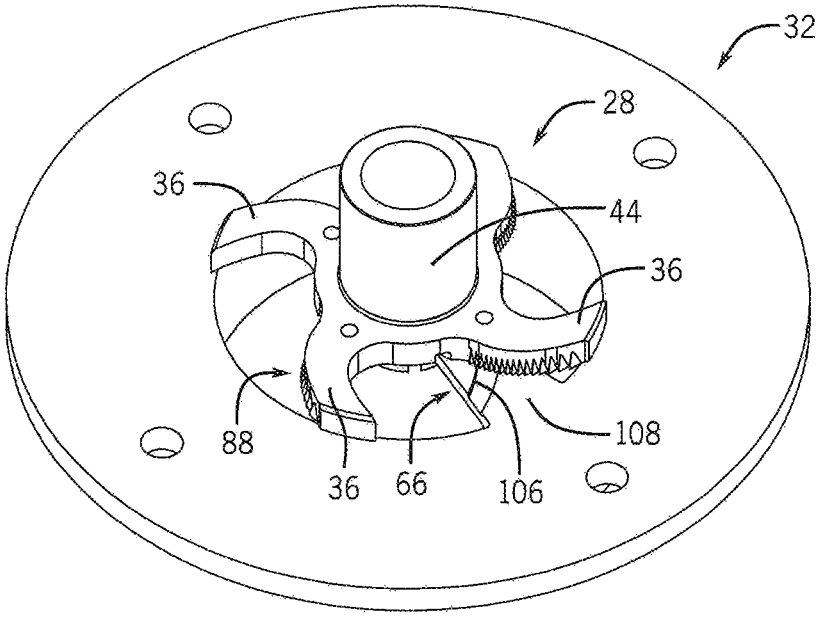
FIG. 11 is a back perspective view of the cutting insert inserted into the cutting plate of the chopper pump of FIG. 1.
Figure 12:
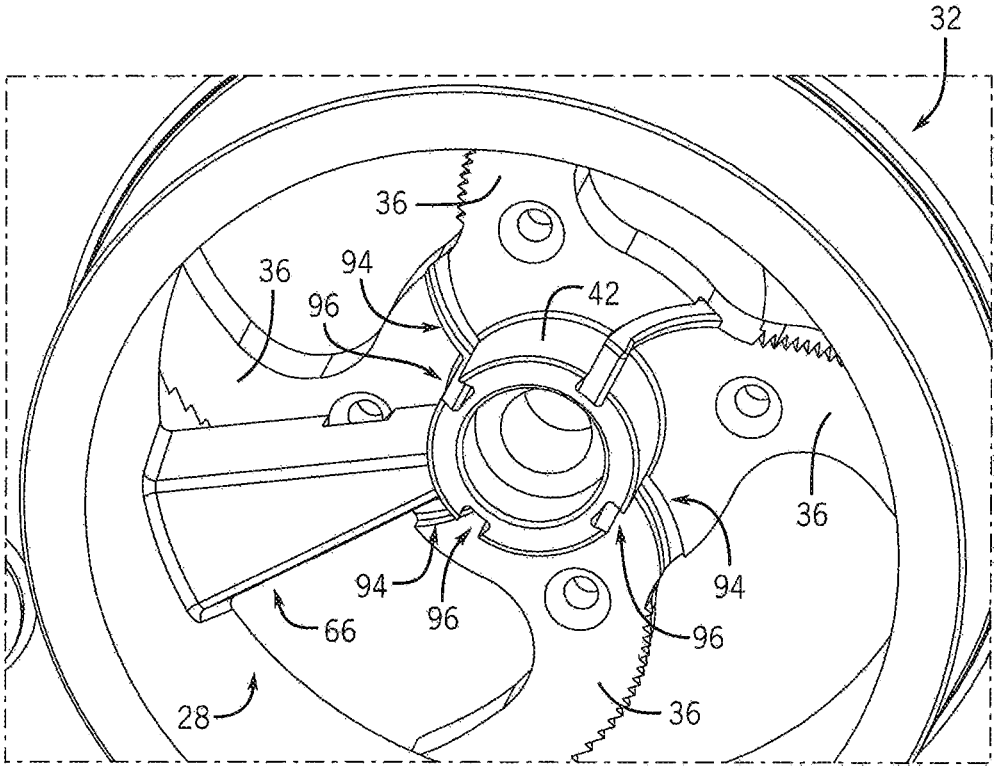
FIG. 12 is a front perspective view of the cutting insert inserted into the cutting plate of the chopper pump of FIG. 1.

When the cutting assembly 26 is assembled as shown in FIGS. 10-12, the cutting insert 28 is fastened within the recess 58 of the impeller 30 for rotation therewith. With the cutting insert 28 fastened within the recess 58, each of the cutting blades 36 acts as an extension of the respective vane 52 of the impeller 30. The forward first protrusion 42 of the cutting insert 28 is dimensioned to extend through the concave distal end 100 of the cutting extension 66.

During operation of the chopper pump 10, the drive section 12 is configured to rotate the impeller 30, and thereby the cutting insert 28, in a desired direction. The rotation of the impeller 30 creates a low pressure at the inlet 18 that draws a process fluid into the inlet 18. From the inlet 18, the process fluid is drawn into the internal cavity 24 of the housing 16 where rotation of the impeller 30 centrifugally furnishes the process fluid to the outlet 20 at an increased pressure.

While the process fluid is passing from the inlet 18 to the outlet 20 during operation of the chopper pump 10, the process fluid flows through the cutting assembly 26. In particular, rotation of the impeller 30 rotates the cutting blades 36 of the cutting insert 28 past the cutting, extension 66 of the cutting plate 32. The leading edges 86 of the cutting insert 28, which include the plurality of serrated teeth 90, rotate past the cutting extension 66 and over the extension groove 106 in a scissor-type cutting action to break up and engage solids in the incoming process fluid flow. Additionally, the serrated teeth 90 may engage and break up string-like materials prior to entering, the internal cavity 16. Further, the axial portions 96 of the cutting grooves 92 rotate past the distal ends 100 of the cutting extension 66, and the radial portions 94 of the cutting grooves 92 rotate past the extension groove 106 formed in the back surface 108 of the cutting extension 66. Thus, the illustrated cutting assembly 26 provides additional cutting, chopping, or engagement locations by rotation of the axial portions 96 of the cutting grooves 92 past the distal end 100 of the cutting extension 66, and by rotation of the radial portions 94 of the cutting grooves 92 past the extension groove 106 formed in the back surface 108 of the cutting, extension 66. These additional cutting, chopping, and/or engagement locations interact with and may alleviate the influence of solids that can get stuck or trapped within the cutting assembly 26.

Once the chopper pump 10 is powered down, the cutting plate 32 may be axially adjusted with respect to the impeller 30, and the cutting insert 28 fastened therein, by adjusting, an axial depth the fastening elements 82 anchor the fastening elements 84, as described above. Since the cutting insert 28 is a separate, or discrete, component relative to the impeller 30, the impeller 30 may not need to be fabricated from a hardened material. Additionally, since the cutting insert 28 may negate the need for the impeller 30 to be fabricated from a hardened material, the impeller 30 may be trimmed or modified, as desired. Furthermore, if the cutting, chopping, or pumping performance of the chopper pump 10 deteriorates over time, the cutting insert 28 or the impeller 30 may be replaced independently as required, and as opposed to an entire impeller structure.

Figure 13:
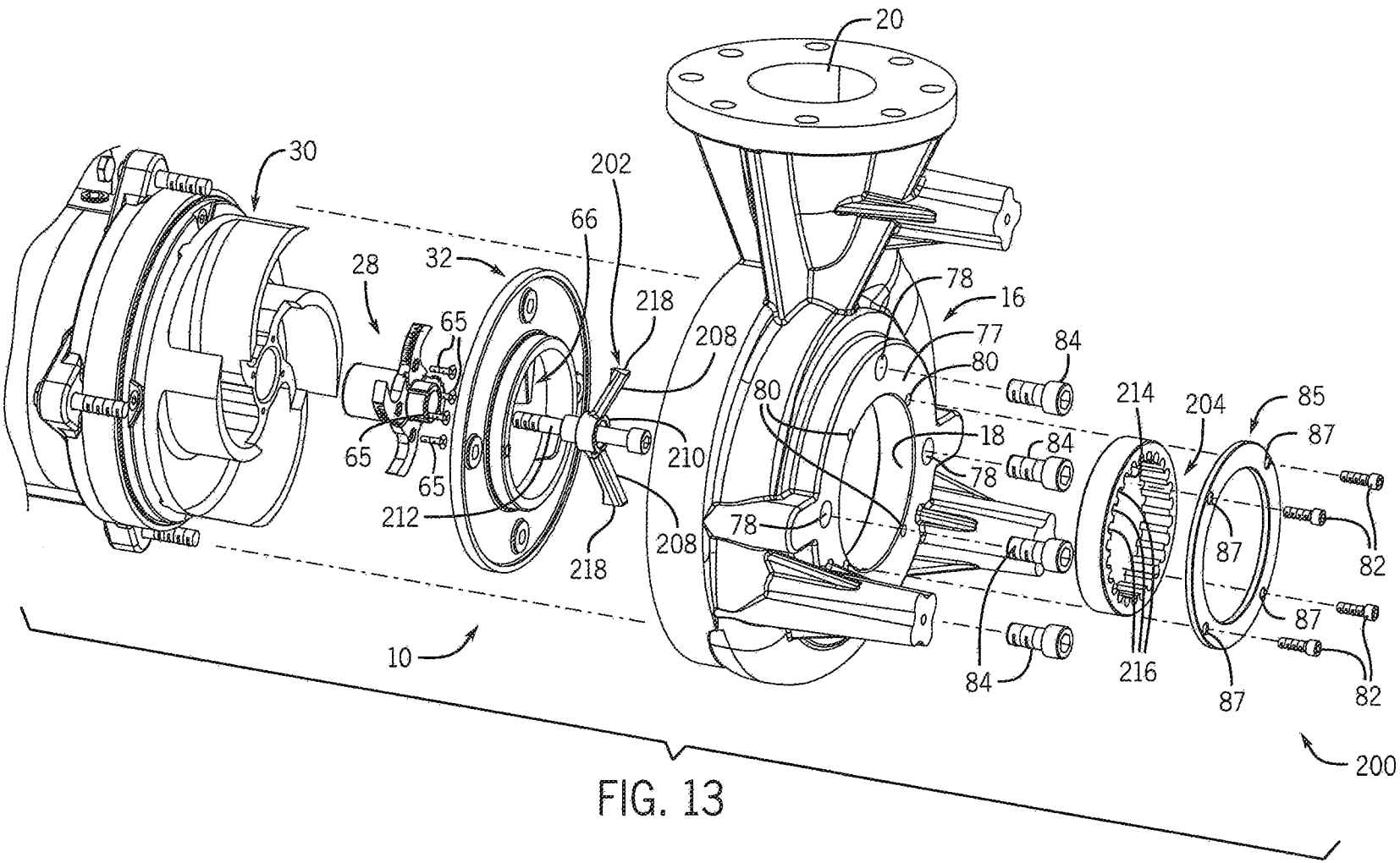
FIG. 13 is an exploded view of a cutting assembly and a housing of a chopper pump according to another embodiment of the invention.
Figure 14:
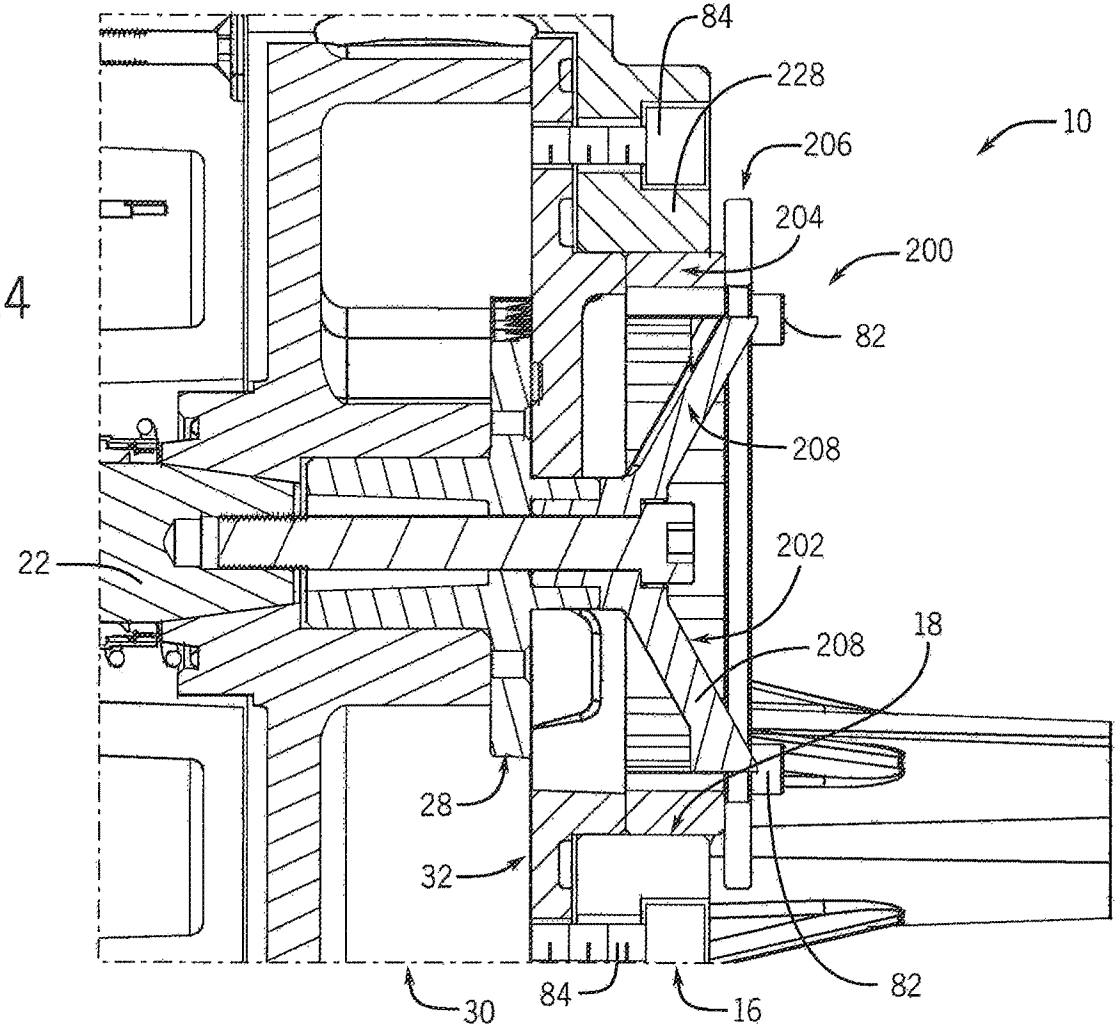
FIG. 14 is a partial cross-sectional view of the chopper pump and cutting assembly of FIG. 13.

FIGS. 13-16 illustrate a cutting assembly 200 of the pump 10 according to another embodiment of the present invention. The cutting assembly 200 is similar to the cutting assembly 26, except as described below or illustrated in FIGS. 13-16. Similar features are identified using like reference numerals. As shown in FIGS. 13 and 14, the cutting assembly 200 further includes a shredder 202 and a cutter ring 204. The shredder 202 forms a generally T-shaped cutter including a pair of opposing shredder extensions 208. The shredder extensions 208 extend angularly outward from an annular shredder hub 210. That is, the shredder extensions 208 are angled with respect to a center axis defined by the shredder 202 and extend toward the cutter ring 204.

A coupling member 212 is configured to be received through the shredder hub 210 and couple the shredder 202 to the drive shaft 22 and the impeller 30 for rotation therewith. When assembled, the cutting insert 28 is positioned between the shredder 202 and the impeller 30. The cutter ring 204 is dimensioned to be received within the inlet 18 of the housing 16. An inner surface 214 of the cutter ring 204 includes a plurality of cutting recesses 216 arranged circumferentially around the inner surface 214. The plurality of cutting recesses 216 each define a generally U-shaped cutout on the inner surface 214 of the cutter ring 204.

When assembled, as shown in FIG. 14, the cutter ring 204 partially protrudes from the inlet 18 of the housing 16. The cutter ring 204 is secured between the cutting plate 32 and the retainer plate 206, when the fastening elements 82 are fastened into the threaded ring apertures 80 of the housing 16. The ends 218 of the shredder extensions 208 are configured to rotate past the plurality of cutting recesses 216 as the shredder 202 rotates with the impeller 30.

Figure 15:
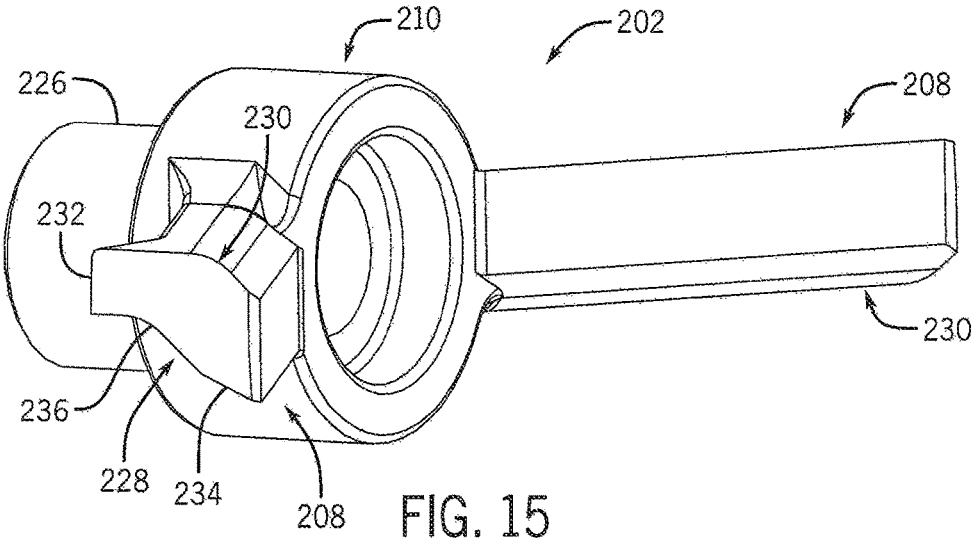
FIG. 15 is a perspective view of a shredder of the chopper pump and cutting assembly of FIG. 13.
Figure 16:
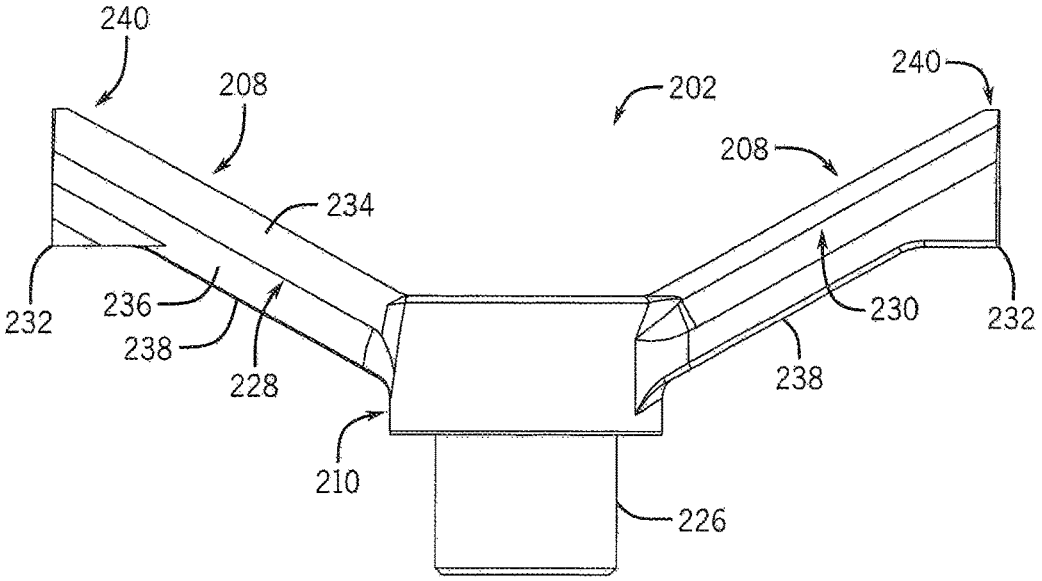
FIG. 16 is a side view of the shredder of FIG. 15.

With reference to FIGS. 15 and 16, the annular shredder hub 210 of the shredder 202 includes a rearward protrusion 226 dimensioned to be received by the forward protrusion 42 of the cutting insert 28. To assemble the shredder 202 and the cutting insert 28, the rearward protrusion 226 may be inserted into the forward first protrusion 42 of the cutting insert 28. Then, the coupling member 212 can be inserted through the annular shredder hub 210, the insert central hub 38, and the central hub 56 of the impeller 30 and fastened to the drive shaft 22. With the coupling member 212 fastened to the drive shaft 22, the impeller 30, the cutting insert 28, and the shredder 202 are rotationally coupled to the drive shaft 22. In one embodiment, the rearward protrusion 226 and/or the forward first protrusion 42 may be keyed to prevent rotationally slipping between the shredder 202 and the impeller 30/the cutting insert 28.

The shredder extensions 208 include a first shredding surface 228, a second shredding surface 230, and a tip protrusion 232. The first shredding surface 228 defines a generally S shaped profile and includes a convex portion 234 and a concave portion 236. The second shredding surface 230 defines a generally convex profile. The tip protrusions 232 form a generally triangular shaped extension protruding from a lower surface 238 of each shredder extension 208 adjacent to a distal tip end 240 thereof. The combination of the first shredding surfaces 228 and the second shredding surfaces 230 provide each shredder extension 208 with a generally frustoconical shape that tapers towards the lower surface 238. That is, a thickness of the shredder extensions 208 may decrease as it extends toward the lower surface 238.

In operation, the cutting action between the cutting insert 28 and the cutting plate 32 for the cutting assembly 200 is similar to the operation of the cutting assembly 26, described above. In addition, the shredder 202 rotates with the drive shaft 22, which rotates the shredder extensions 208 within the cutter ring 204 past the plurality of cutting recesses 216. The rotation of the shredder extensions 208 within the cutter ring 204 can push debris away from the suction within the inlet 18 to attempt to prevent the inlet 18 from becoming completely blocked by debris. Also, the frustoconical shape defined by the shredder extensions 208 helps improve performance of the pump 10 by increasing flow. That is, the frustoconical shape improves flow by enabling the shredder 202 to act as a stage where rotation of the shredder 202 results in pumping of the fluid prior to the fluid entering and/or passing through the inlet 18.

Figure 17:
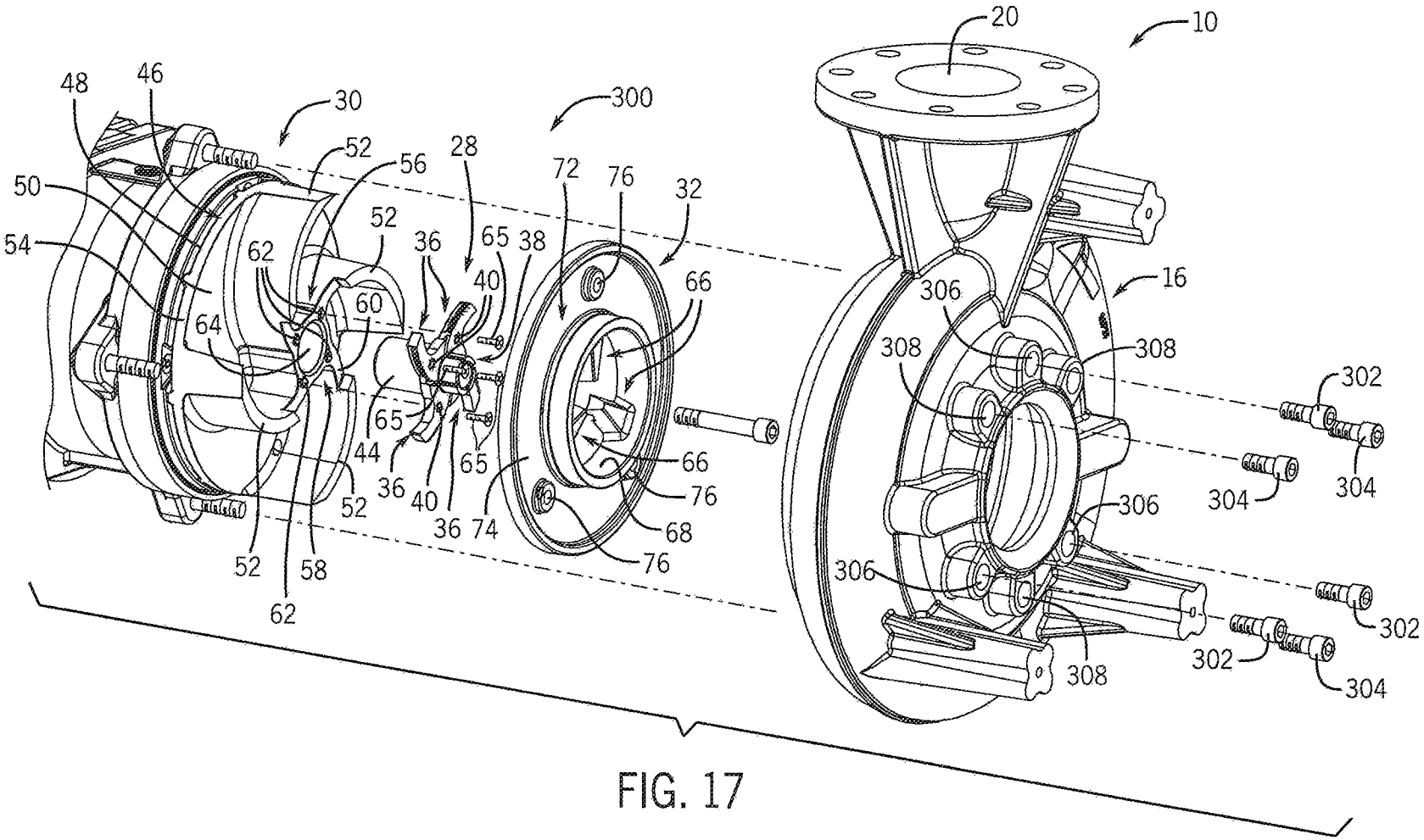
FIG. 17 is an exploded view of a cutting assembly and a housing of a chopper pump according to another embodiment of the invention.
Figure 18:
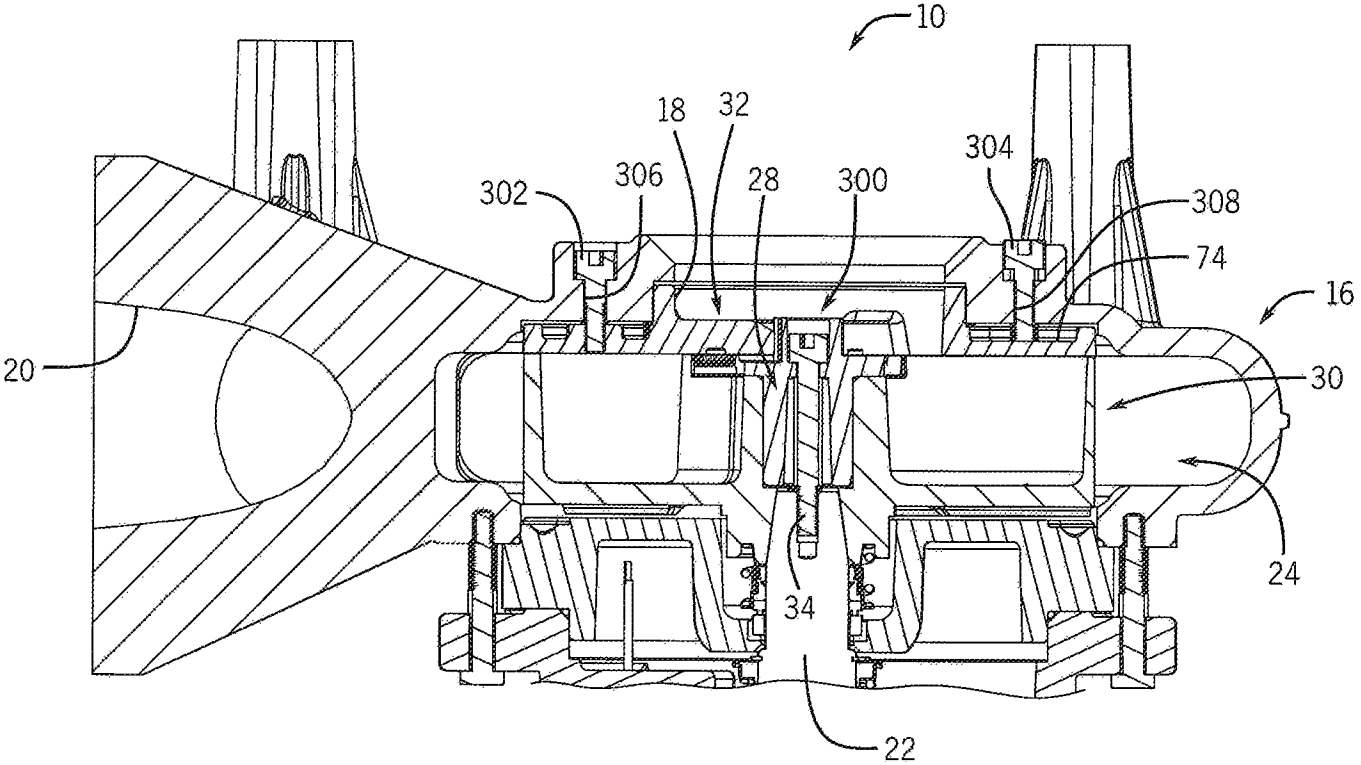
FIG. 18 is a partial cross-sectional view of the chopper pump and cutting assembly of FIG. 17.

FIGS. 17 and 18 illustrate a cutting assembly 300 of the pump 10 according to another embodiment of the present invention. The cutting assembly 300 is similar to the cutting assembly 26, except as described below or illustrated in FIGS. 17 and 18. Similar features are identified using like reference numerals. As shown in FIGS. 17 and 18, the cutting plate 32 includes three cutting extensions 66 arranged circumferentially around the inner surface 68 in approximately 120 degree increments. The mounting surface 68 includes three threaded mounting apertures 76. In the illustrated example, the cutting assembly 300 may not include the retainer ring 85. Instead, the axial position of the cutting plate 32 may be controlled via the interaction between the cutting plate 32 and a plurality of adjusting fastening elements 302 and a plurality of set fastening element 304.

The housing 16 includes a plurality of adjusting apertures 306 and a plurality of set apertures 308. The plurality of adjusting, apertures 306 and the plurality of set apertures 308 are alternatingly arranged circumferentially around the inlet 18 of the housing 16. The plurality of adjusting apertures 306 are dimensioned to receive one of the adjusting fastening elements 302, which may be in the form of a threaded bolt. The plurality of set apertures 308 are dimensioned to threadingly receive one of the set fastening elements 304, which may be in the form of a threaded bolt.

When assembled, the plurality of adjusting fastening elements 302 extend through a corresponding one of the adjusting apertures 306 and into a corresponding one of the plurality of threaded mounting apertures 76. This fastens the cutting plate 32 within the internal cavity 24 of the housing 16 adjacent to the inlet 18. The set fastening elements 304 are threaded through a corresponding one of the plurality of adjusting apertures 308 to engage the mounting surface 74 of the cutting plate 32. In this way, the set fastening elements 304 act as a standoff or spacer to control an axial distance between the cutting plate 32 and the cutting insert 28. That is, the cutting plate 32 is axially adjustable by adjusting an axial depth of the plurality of set fastening elements 304 and subsequently adjusting the adjusting fastening elements 302 until the mounting surface 74 of the cutting plate 32 engages the plurality of set fastening elements 304.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A cutting assembly for a chopper pump, the cutting assembly comprising:

a cutting insert including a cutting blade extending radially therefrom and having a cutting blade thickness;

an impeller including a central hub, a plurality of vanes, and an insert surface, wherein the insert surface defines an axial recess having an axial depth that is congruent with the cutting blade thickness and is dimensioned to receive the cutting insert therein; and a cutting plate including a plate hub having a cutting extension protruding radially inward therefrom, wherein rotation of the impeller rotates the cutting blade past the cutting extension.

2. The cutting assembly of claim 1, wherein the cutting insert includes a plurality of cutting blades extending radially from an insert central hub.

3. The cutting assembly of claim 2, wherein the plurality of cutting blades define a substantially curved shape.

4. The cutting assembly of claim 2, wherein the plurality of cutting blades each include a leading edge having a plurality of serrated teethed arranged therealong.

5. The cutting assembly of claim 1, wherein the insert surface includes a plurality of insert apertures recessed therein and arranged circumferentially around the central hub, and wherein the plurality of insert apertures are arranged to align with a corresponding plurality of mounting apertures on the cutting insert.

6. The cutting assembly of claim 5, wherein the plurality of insert apertures and the plurality of mounting apertures are configured to receive a fastening element to rotationally secure the cutting insert to the impeller.

7. The cutting assembly of claim 1, wherein the cutting insert includes a cutting groove arranged thereon that defines a recess having a radial section and an axial section.

8. The cutting assembly of claim 7, wherein the radial section is axially recessed into the cutting insert and extends radially along a substantially curved profile.

9. The cutting assembly of claim 7, wherein the axial section is radially recessed into a protrusion of the cutting insert and extends axially along the length of the protrusion in a substantially linear profile.

10. The cutting assembly of claim 1, wherein the cutting extension defines a substantially frustoconical shape.

11. The cutting assembly of claim 1, wherein the cutting extension includes, a first cutting edge, a second cutting edge, a proximal end, and a distal end.

12. The cutting assembly of claim 11, wherein the distal end defines a generally concave shape.

13. The cutting assembly of claim 11, wherein the cutting extension includes an extension groove axially recessed therein.

14. The cutting assembly of claim 13, wherein the extension groove extends radially along a substantially curved profile from a location on the first cutting edge adjacent to the distal end to a location on the second cutting edge adjacent to the proximal end.

15. A chopper pump comprising:

a drive section including a drive shaft;

a housing coupled to the drive section and including an inlet, an outlet, and an internal cavity arranged between the inlet and the outlet;

an impeller received within the internal cavity and coupled to the drive shaft for rotation therewith, the impeller including an external impeller surface and a recess formed therein;

a cutting insert received within the recess of the impeller and including a cutting blade having an external blade surface, wherein the external impeller surface and the external blade surface are substantially flush with one another; and a cutting plate coupled to the housing within the internal cavity, the cutting plate including a cutting extension that extends radially inward, wherein rotation of the impeller rotates the cutting blade past the cutting extension.

16. The chopper pump of claim 15, wherein a leading edge of the cutting blade includes a plurality of serrated teeth arranged therealong.

17. The chopper pump of claim 15, wherein the cutting insert includes a cutting groove arranged thereon that defines a recess having a radial section and an axial section.

18. The chopper pump of claim 15, wherein the cutting extension includes an extension groove axially recessed therein.

19. The chopper pump of claim 18, wherein the extension groove extends radially along a substantially curved profile from a location on a first cutting edge adjacent to a distal end of the cutting extension to a location on a second cutting edge adjacent to a proximal end of the cutting extension.

20. The chopper pump of claim 15, wherein the cutting plate is axially adjustable with respect to the impeller.

21. A cutting assembly for a chopper pump, the cutting assembly comprising:

a cutting insert including a cutting blade extending radially therefrom;

an impeller including a central hub, a plurality of vanes, and an insert surface, wherein the insert surface defines an axial recess that is dimensioned to receive the cutting insert therein, wherein the insert surface includes a plurality of insert apertures recessed therein and arranged circumferentially around the central hub, and wherein the plurality of insert apertures are arranged to align with a corresponding plurality of mounting apertures on the cutting insert; and a cutting plate including a plate hub having a cutting extension protruding radially inward therefrom, wherein rotation of the impeller rotates the cutting blade past the cutting extension.

* * * * *